US008138933B2

(12) United States Patent
Crucs

(10) Patent No.: US 8,138,933 B2
(45) Date of Patent: Mar. 20, 2012

(54) SYSTEMS, METHODS, AND APPARATUS FOR AUTOMATICALLY DISABLING APPLIANCES IN RESPONSE TO A SMOKE DETECTOR

(75) Inventor: Kevin M. Crucs, Copley, OH (US)

(73) Assignee: Crucs Holdings, LLC, Copley, OH (US)

( * ) Notice: Subject to any disclaimer, the term of this patent is extended or adjusted under 35 U.S.C. 154(b) by 410 days.

(21) Appl. No.: 12/264,949

(22) Filed: Nov. 5, 2008

(65) Prior Publication Data

US 2010/0109887 A1 May 6, 2010

(51) Int. Cl.
*G08B 17/10* (2006.01)
*G08B 21/00* (2006.01)

(52) U.S. Cl. ..... 340/628; 340/630; 340/632

(58) Field of Classification Search ..... 340/628, 340/632, 693.6, 539.1, 825.72, 286.02; 219/481, 219/497, 494; 3/628, 632, 693.6, 539.1, 3/825.72, 286.02
See application file for complete search history.

(56) References Cited

U.S. PATENT DOCUMENTS

| | | | | |
|---|---|---|---|---|
| 4,223,692 | A * | 9/1980 | Perry | 137/78.4 |
| 4,602,653 | A | 7/1986 | Ruiz-Vela et al. | |
| 4,849,951 | A | 7/1989 | Jauch | |
| 4,908,807 | A | 3/1990 | Jauch | |
| 5,528,131 | A | 6/1996 | Marty et al. | |
| 5,838,243 | A * | 11/1998 | Gallo | 340/632 |
| 6,032,663 | A * | 3/2000 | Pencheon | 126/42 |
| 6,130,412 | A * | 10/2000 | Sizemore | 219/481 |
| 6,297,746 | B1 * | 10/2001 | Nakazawa et al. | 340/825.69 |
| 6,590,481 | B2 | 7/2003 | Turner et al. | |
| 7,230,299 | B2 | 6/2007 | Robb et al. | |
| 7,230,470 | B1 | 6/2007 | You et al. | |
| 7,327,246 | B2 * | 2/2008 | Schoor | 340/506 |
| 7,696,891 | B2 * | 4/2010 | Whitney | 340/628 |
| 2004/0180305 | A1 | 9/2004 | Dempsey et al. | |
| 2006/0141409 | A1 | 6/2006 | Chian et al. | |
| 2008/0018484 | A1 * | 1/2008 | Sager | 340/628 |
| 2008/0157936 | A1 * | 7/2008 | Ebrom et al. | 340/286.02 |
| 2008/0231468 | A1 * | 9/2008 | Myllymaki | 340/870.17 |

FOREIGN PATENT DOCUMENTS

| | | | |
|---|---|---|---|
| JP | 05-240447 | A | 9/1993 |
| JP | 2002-122325 | A | 4/2002 |
| KR | 20-1994-0016539 | U | 7/1994 |

* cited by examiner

*Primary Examiner* — Julie Lieu
(74) *Attorney, Agent, or Firm* — Hahn Loeser & Parks LLP

(57) ABSTRACT

Systems, methods, and apparatus for automatically disabling an appliance. When a smoke detector/alarm is activated, a signal or message is sent to at least one safety device operatively coupled to at least one appliance. The appliance is disabled in response to receiving the signal or message. The systems, methods, and apparatus are based on the implicit assumption that, if a smoke detector/alarm is activated, the source of the smoke is likely due to a nearby appliance that is in use.

23 Claims, 6 Drawing Sheets

SYSTEMS, METHODS, AND APPARATUS FOR AUTOMATICALLY DISABLING APPLIANCES IN RESPONSE TO A SMOKE DETECTOR

TECHNICAL FIELD

Certain embodiments of the present invention relate to automated safety capabilities for appliances. More particularly, certain embodiments relate to safety devices for disabling appliances in response to the activation of a smoke alarm.

BACKGROUND

Gas or electric stoves and ovens and microwave ovens are found in most homes and apartments, and also in some office buildings, for example. Fires are often accidentally started by such appliances if they are left unattended. A smoke detector in the vicinity of the fire is able to detect smoke caused by the fire and activate an alarm to alert people about the fire. However, until someone arrives at the appliance to shut off the appliance after being alerted by the activated smoke detector, the appliance may continue to fuel the fire.

Further limitations and disadvantages of conventional, traditional, and proposed approaches will become apparent to one of skill in the art, through comparison of such approaches with the subject matter of the present application as set forth in the remainder of the present application with reference to the drawings.

SUMMARY

An embodiment of the present invention comprises a method of automatically disabling an appliance. The method includes generating a signal within a smoke detector indicative of an alarm of the smoke detector being activated. The method further includes sending the signal to at least one safety device operatively coupling a source of energy to at least one appliance. The method also includes the at least one safety device automatically de-coupling the source of energy from the at least one appliance in response to the generated signal.

Another embodiment of the present invention comprises a method of automatically disabling an appliance. The method includes generating a signal within a smoke detector indicative of an alarm of the smoke detector being activated and sending the signal to a central computer. The method further includes the central computer sending a message to at least one safety device in response to the signal, wherein the at least one safety device operatively couples a source of energy to at least one appliance. The method also includes the at least one safety device automatically de-coupling the source of energy from the at least one appliance in response to the message.

In accordance with an embodiment of the present invention, the automatically de-coupling includes opening a conductive electrical path within the at least one safety device to prevent electricity from flowing to an electric burner of the at least one appliance. In accordance with an embodiment of the present invention, the automatically de-coupling includes closing a gas valve of the at least one safety device to prevent a combustible gas from flowing to a gas burner of the at least one appliance. In accordance with an embodiment of the present invention, the automatically de-coupling includes opening a conductive electrical path within the at least one safety device to prevent electricity from flowing to a microwave energy source of the at least one appliance. The method may further include manually re-coupling the source of energy to the at least one appliance via a reset button on the at least one safety device. The method may instead or in addition include automatically re-coupling the source of energy to the at least one appliance via the central computer. In accordance with certain embodiments of the present invention, the at least one appliance may include a gas stove, an electric stove, a gas oven, an electric oven, a microwave oven, a gas furnace, an electric furnace, a heat pump, an electric skillet, a hot plate, or a combination thereof, for example.

A further embodiment of the present invention comprises a system providing an automatic safety capability. The system includes at least one appliance, means for operatively coupling a source of energy to the at least one appliance, means for detecting smoke and generating a signal in response to detecting smoke, means for communicating the signal to the means for operatively coupling, and means for automatically de-coupling the source of energy from the at least one appliance in response to the generated signal.

Another embodiment of the present invention comprises a system providing an automatic safety capability. The system includes at least one appliance, means for operatively coupling a source of energy to the at least one appliance, means for detecting smoke and generating a signal in response to detecting smoke, means for receiving the signal and generating a message in response to receiving the signal, means for communicating the message to the means for operatively coupling, and means for automatically de-coupling the source of energy from the at least one appliance in response to the message.

The system may further include means for manually re-coupling the source of energy to the at least one appliance. The system may instead or in addition include means for automatically re-coupling the source of energy to the at least one appliance. In accordance with certain embodiments of the present invention, the at least one appliance may include a gas stove, an electric stove, a gas oven, an electric oven, a microwave oven, a gas furnace, an electric furnace, a heat pump, an electric skillet, a hot plate, or a combination thereof, for example.

A further embodiment of the present invention comprises an automated safety device. The automated safety device includes a two-state gas valve having a gas input port and a gas output port and capable of providing a flow state and a non-flow state. The automated safety device also includes a switch operatively connected to the two-state gas valve to change the gas valve from the flow state to the non-flow state in response to a signal. The safety device may further include a power source operatively coupled to the switch for providing electrical power used by the switch. The safety device may also include a reset device operatively connected to the switch to manually reset the switch such that the gas valve changes from the non-flow state to the flow state. The safety device may further include a communication interface and microcontroller operatively connected to the switch to receive a message from an external central computer and to provide the signal to the switch in response to the message. The safety device may also include a power source operatively connected to the communication interface and microcontroller for providing electrical power used by the communication interface and microcontroller.

Another embodiment of the present invention comprises an automated safety device. The safety device includes an electrical on/off power switch having an electrical power input port and an electrical power output port and capable of switching from a conductive state to a non-conductive state in response to a signal. The safety device may further include a power source operatively connected to the electrical on/off power switch for providing electrical power used by the electrical on/off power switch. The safety device may also include a reset device operatively connected to the electrical on/off power switch to manually reset the electrical on/off power switch back to the conductive state. The safety device may further include a communication interface and microcontroller operatively connected to the electrical on/off power switch to receive a message from an external central computer and to provide the signal to the electrical on/off power switch in response to the message. The safety device may also include a power source operatively connected to the communication interface and microcontroller for providing electrical power used by the communication interface and microcontroller.

These and other novel features of the subject matter of the present application, as well as details of illustrated embodiments thereof, will be more fully understood from the following description and drawings.

DETAILED DESCRIPTION

Figure 1:
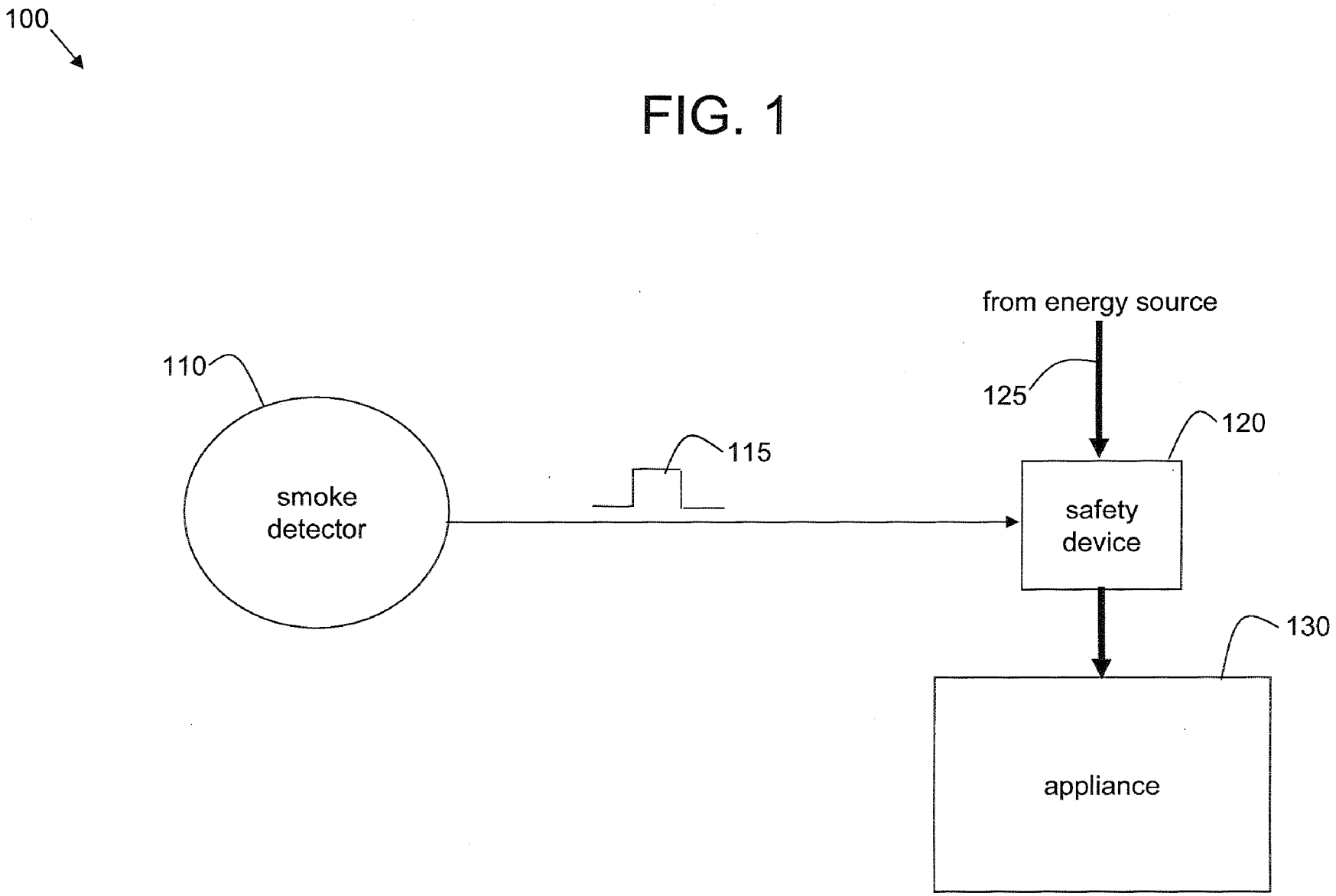
FIG. 1 illustrates a functional block diagram of a first embodiment of a system for disabling an appliance in response to a signal from a smoke detector.

FIG. 1 illustrates a functional block diagram of a first embodiment of a system 100 for disabling an appliance in response to a signal from a smoke detector. The system 100 includes a smoke detector (a.k.a. a smoke alarm) 110 and an appliance 130. The appliance 130 may be, for example, a gas stove, an electric stove, a gas oven, an electric oven, a microwave oven, a gas furnace, an electric furnace, a heat pump, an electric skillet, a hot plate, or a combination thereof. Other types of appliances are possible as well.

The system 100 also includes a safety device 120. The safety device 120 is operatively connected to the smoke detector 110 and the appliance 130. The safety device 120 is connected between an energy source (e.g., a combustible gas source or an electric source) and the appliance 130 in, for example, a main line 125 leading from the energy source to the appliance 130. During normal operation, the safety device 120 allows energy (e.g., natural gas or electricity) to pass from the energy source to the appliance 130. However, if the smoke detector 110 detects smoke and activates an alarm, a signal 115 is generated within the smoke detector 110 and is sent from the smoke detector 110 to the safety device 120. The safety device 120 effectively blocks the flow of energy from the energy source to the appliance 130 in response to the signal 115 from the smoke detector 110. Therefore, if the appliance 130 is the source of the detected smoke, then disabling the appliance 130 by blocking the flow of energy to the appliance 130 may help reduce or extinguish any associated fire causing the smoke.

In accordance with various embodiments of the present invention, the signal 115 may be sent from the smoke detector 110 to the safety device 120 via wired means or wirelessly. The signal 115 may be a radio frequency (RF) signal, a pulsed signal, or a simple voltage level, for example. If the signal 115 is an RF signal, the smoke detector 110 may include an RF transmitter to transmit the signal 115 and the safety device 120 may include an RF receiver to receive the signal 115. Such RF transmitters and receivers are well known in the art. In accordance with another embodiment of the present invention, the smoke detector 110 may be operatively connected to multiple safety devices 120, where each safety device 110 is operatively connected to a different appliance 130.

Figure 2:
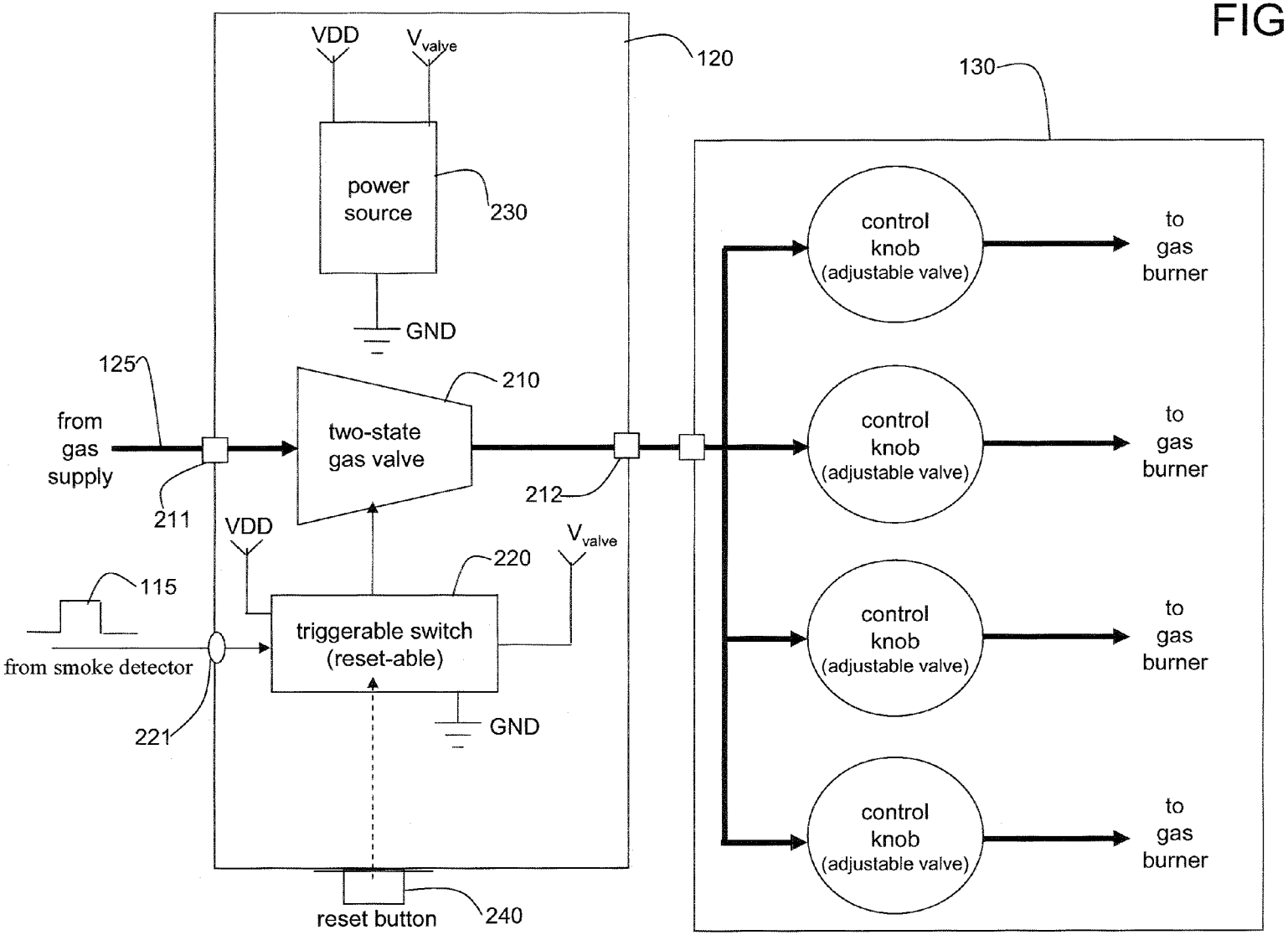
FIG. 2 illustrates a first embodiment of a safety device operatively connected to a first embodiment of an appliance for providing gas to at least one gas burner and used in the system of FIG. 1.

FIG. 2 illustrates a first embodiment of a safety device 120 operatively connected to a first embodiment of an appliance 130 for providing gas to at least one gas burner and used in the system 100 of FIG. 1. As shown in FIG. 2, a main gas line 125 from a gas supply (energy source) is connected to an input port 211 of the safety device 120. An output port 212 of the safety device 120 is connected to the gas appliance 130. In this manner, the safety device 120 is able to allow gas to pass from the gas supply to the gas appliance 130. The gas appliance 130 may be a stove and/or oven, a furnace, or some other appliance that operates using combustible natural gas or propane, for example.

The first embodiment of the safety device 120 includes a two-state gas valve 210 operatively connected to a triggerable switch 220. The two-state gas valve 210 is capable of being in a first flowing state (allowing gas to pass through the valve 210) or a second non-flowing state (preventing gas from passing through the valve 210). Gas coming into the input port 211 of the safety device 120 enters the gas valve 210. Gas leaves the gas valve 210 and exits through the output port 212 of the safety device 120.

FIG. 2 shows four control knobs within the appliance 130, each controlling an adjustable gas valve to provide gas to a separate stove burner. Gas out of the safety device 120 supplies gas for all four gas stove burners. The appliance 130 may also include an oven having at least one burner which is also supplied by gas passing through the safety device 120. During normal operation, the flow of gas follows a path from a gas supply through the two-state gas valve 210, through an adjustable gas valve of the appliance 130, and to a gas burner. A user may turn or rotate a control knob of the appliance 130 to initiate the turning on of a gas burner as described herein. The further a user rotates the control knob of the appliance 130, the more the adjustable gas valve of the appliance 120 opens. In this way, a user is able to adjust the amount of gas flowing between the gas supply and the gas burner and, therefore, the level of the resultant flame at the gas burner and the amount of heat being generated by the burner. When the gas reaches a gas burner, the gas may be ignited by, for example, an electric spark starter or a pilot light and, therefore, the gas burner is turned on.

When the smoke detector 110 is activated (i.e., detects smoke), the smoke detector 110 generates a trigger pulse signal 115 that is sent to the safety device 120. The trigger pulse signal 115 from the smoke detector 110 enters the safety device via an electrical connector port 221 and causes the triggerable switch 220 to turn on or close, allowing a voltage $V_{valve}$ to be applied to an input of the two-state gas valve 210.

The triggerable switch 220 is of the type that is triggered by a change (rising edge or falling edge) in a voltage logic level (e.g., the signal 115 transitioning from 0 VDC to 5 VDC). In accordance with an embodiment of the present invention, the triggerable switch includes at least one transistor. Such switches are well known in the art. The voltage $V_{valve}$ causes the two-state gas valve 210 to transition from an open (flowing) state to a closed (non-flowing) state, preventing gas from the gas supply from passing through the two-state gas valve 210 and on to the gas appliance 130.

The smoke detector 110 includes a one-shot device that is enabled by the smoke detector 110 when smoke is detected and generates the trigger pulse signal 115. Such one-shot devices are well known in the art. However, other types of devices may be used to generate the trigger pulse signal 115 as well. Furthermore, in accordance with other embodiments of the present invention, the triggerable switch 220 may be of a type that is triggered by a voltage logic level instead of a transitioning pulse (e.g., outputting 5 VDC, a logic high level). Such switches are well known in the art. In such an embodiment, the smoke detector 110 generates and outputs the voltage logic level using standard, well known digital circuitry.

In accordance with an embodiment of the present invention, the two-state gas valve 210 has an electromagnet inside which causes the gas valve 210 to close when a small charge or voltage $V_{valve}$ is applied at the electromagnet. Such gas valves are well known in the art. Other types of charge or voltage controlled gas valves may be possible as well. In accordance with an alternative embodiment of the present invention, the gas valve 210 may operate in an opposite manner. That is, the gas valve 210 may open when a small charge or voltage $V_{valve}$ is applied at the electromagnet. In such an embodiment, the voltage $V_{valve}$ would be applied to the gas valve 210 during normal operation, and when the signal 115 triggers the switch 220, the voltage $V_{valve}$ would be disconnected from the gas valve 210, causing the gas valve 210 to close.

Certain devices of the safety apparatus 120 may require electric power to be applied in order to function. For example, the triggerable switch 220 may require a voltage VDD and a ground potential GND to be applied, as shown in FIG. 2, in order to operate as described herein. The voltages VDD, $V_{valve}$, and the ground potential GND may be provided by a power source 230 which may be part of the safety device 120.

In accordance with an embodiment of the present invention, the power source 230 may include one or more batteries along with other circuitry for forming the direct current (DC) voltages VDD and $V_{valve}$ with respect to a ground potential GND. In accordance with another embodiment of the present invention, the power source 230 may include a power regulator/converter that takes in alternating current (AC) from, for example, a standard 220 VAC power source or a 110 VAC power source and converts the AC voltage to DC voltages VDD and $V_{valve}$. Such power sources are well known in the art. For example, VDD may be 5.0 VDC and $V_{valve}$ may be 1.0 VDC, in accordance with an embodiment of the present invention.

In accordance with an embodiment of the present invention, the various devices 220 and 230 may be mounted on a printed circuit board (PCB) which provides the various electrical interfaces between the devices. The PCB with the mounted devices and the two-state gas valve 210 may be mounted substantially internally to the safety device 120 (e.g., within a housing of the safety device 120). The safety device 120 also includes a reset button 240 operatively connected to the triggereable switch 220. The reset button 240 may be used to manually reset the two-state gas valve 210, via the triggerable switch 220, from the non-flowing state to the flowing state. The reset button 240 is mounted on the outside of the safety device 120 to allow user access. Such reset-able switches are well known in the art.

Figure 3:
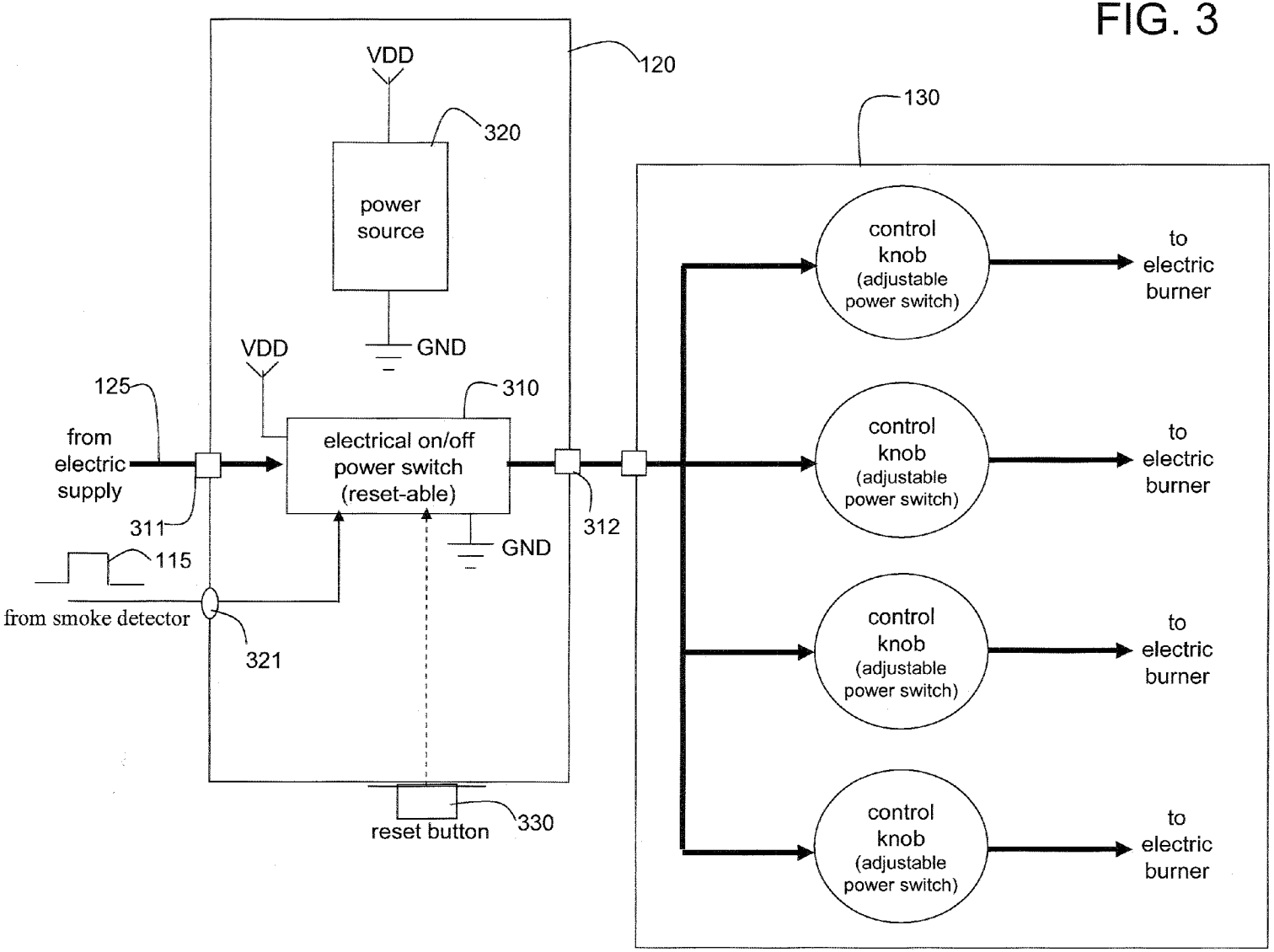
FIG. 3 illustrates a second embodiment of a safety device operatively connected to a second embodiment of an appliance for providing electricity to at least one electric burner and used in the system of FIG. 1.

FIG. 3 illustrates a second embodiment of a safety device 120 operatively connected to a second embodiment of an appliance 130 for providing electricity to at least one electric burner and used in the system 100 of FIG. 1. The appliance 130 may be a stove and/or oven, a furnace, an electric skillet, or some other electric appliance having at least one electric burner that operates using electricity (i.e., electrical current), for example. As shown in FIG. 3, a main electrical line 125 from an electric supply (energy source) is connected to an electrical input connector port 311 of the safety device 120. An electrical output connector port 312 of the safety device 120 is connected to the electric appliance 130. In this manner, the safety device 120 is able to allow electricity to flow between the electric supply and the electric appliance 130.

The second embodiment of the safety device 120 includes an electrical on/off power switch 310. The electrical on/off power switch 310 is capable of being in a first conductive state (allowing electricity to flow through the switch 310) or a second non-conductive state (preventing electricity from flowing through the switch 310). Such electrical on/off power switches or well known in the art. Electricity coming into the input port 311 of the safety device 120 enters the switch 310. Electricity leaves the switch 310 and exits through the output port 312 of the safety device 120. The electrical on/off power switch may be rated to handle, for example, 220 VAC at 30 amps.

FIG. 3 shows four control knobs, each controlling an adjustable power switch to provide electricity to a separate stove burner. Electricity out of the safety device 120 supplies electricity for all four electric stove burners. The appliance 130 may also include an oven having at least one burner which is also supplied by electricity passing through the safety device 120. During normal operation, the flow of electric current follows a path between the electric supply and an electric burner through the electrical on/off power switch 310 of the safety device 120 and through an adjustable power switch of the appliance 130. A user may turn or rotate a control knob of the appliance 130 to initiate the turning on of the electric burner as described herein. The further a user rotates the knob of the appliance 130, the more the adjustable power switch of the appliance 130 provides electric current. In this way, a user is able to adjust the amount of electric current flowing between the electric supply and the electric burner and, therefore, the amount of heat being generated by the burner.

When the smoke detector 110 is activated (i.e., detects smoke), the smoke detector 110 generates a trigger pulse signal 115 that is sent to the safety device 120. The trigger pulse signal 115 from the smoke detector 110 enters the safety device via an electrical connector port 321 and causes the electrical on/off power switch 310 to turn off or open, preventing electrical current from flowing through the switch 310 from the electric supply to the electric appliance 130. The electrical on/off power switch 310 is of the type that is triggered by a change (rising edge or falling edge) in a voltage logic level (e.g., the signal 115 transitioning from 0 VDC to 5 VDC). In accordance with an embodiment of the present invention, the electrical on/off power switch 310 includes at least one power transistor. Such switches are well known in the art. When the electric current reaches a burner, the electric current heats up a coil of the burner and, therefore, the electric burner is turned on.

The smoke detector 110 includes a one-shot device that is enabled by the smoke detector 110 when smoke is detected and generates the trigger pulse signal 115. Such one-shot devices are well known in the art. However, other types of devices may be used to generate the trigger pulse signal 115 as well. Furthermore, in accordance with other embodiments of the present invention, the electrical on/off power switch 310 may be of a type that is triggered by a voltage logic level instead of a transitioning pulse (e.g., outputting 5 VDC, a logic high level). Such switches are well known in the art. In such an embodiment, the smoke detector 110 generates and outputs the voltage logic level using standard, well known digital circuitry.

The electrical on/off power switch 310 may require electric power to be applied in order to function. For example, the switch 310 may require a voltage VDD and a ground potential GND to be applied, as shown in FIG. 3, in order to operate as described herein. The voltage VDD and the ground potential GND may be provided by a power source 320 which may be part of the safety device 120.

In accordance with an embodiment of the present invention, the power source 320 may include one or more batteries along with other circuitry for forming the direct current (DC) voltage VDD with respect to a ground potential GND. In accordance with another embodiment of the present invention, the power source 320 may include a power regulator/converter that takes in alternating current (AC) from, for example, a standard 220 VAC power source or a 110 VAC power source and converts the AC voltage to a DC voltages VDD. Such power sources are well known in the art. For example, VDD may be 5.0 VDC, in accordance with an embodiment of the present invention.

In accordance with an embodiment of the present invention, the various devices 310 and 320 may be mounted on a printed circuit board (PCB) which provides the various electrical interfaces between the devices. The PCB with the mounted devices may be mounted substantially internally to the safety device 120 (e.g., within a housing of the safety device 120). The safety device 120 also includes a reset button 330 operatively connected to the electrical on/off power switch 310. The reset button 330 may be used to manually reset the switch 310, from the non-conductive state to the conductive state. The reset button 330 is mounted on the outside of the safety device 120 to allow user access. Such reset-able power switches are well known in the art.

Figure 4:
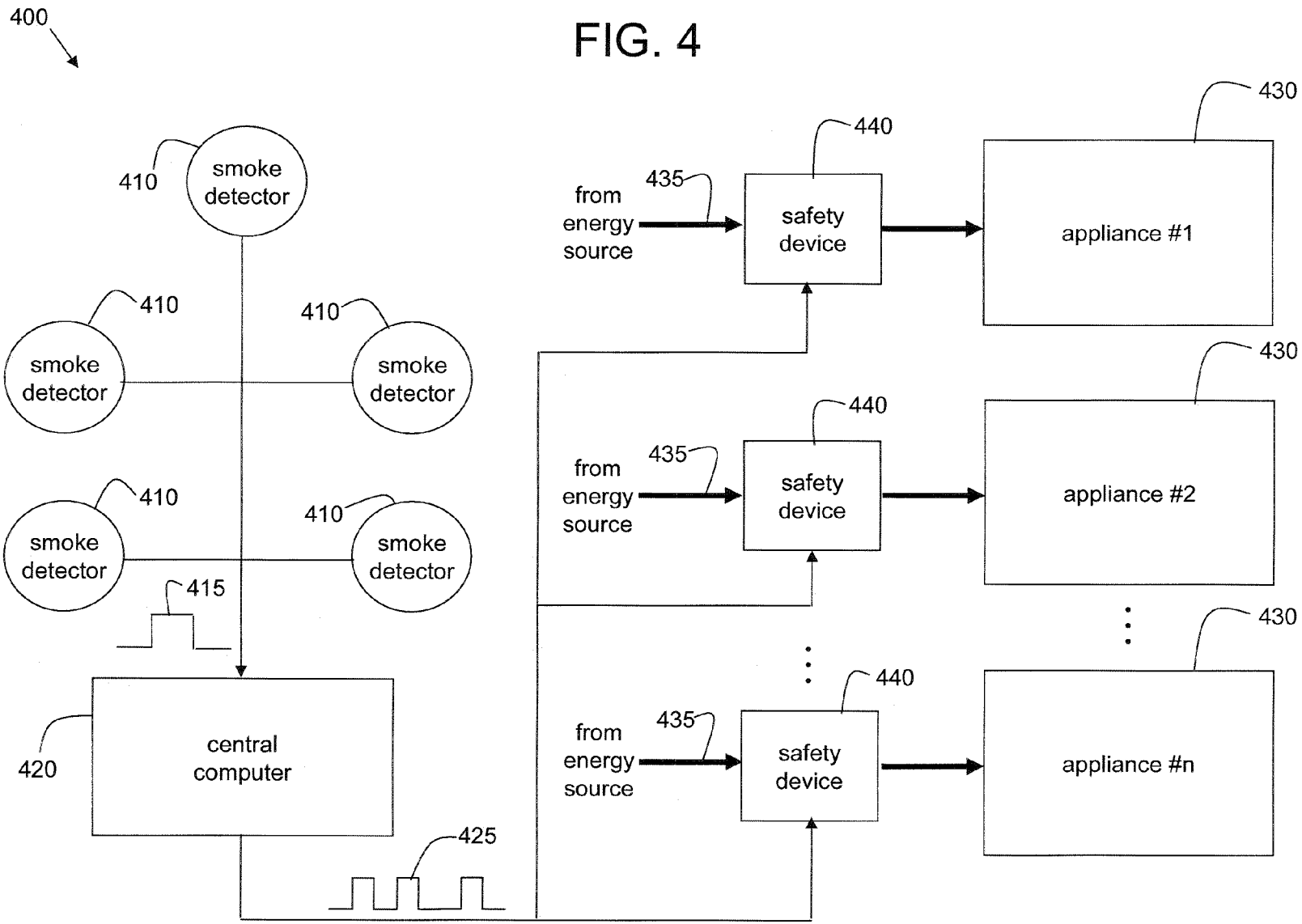
FIG. 4 illustrates a functional block diagram of a second embodiment of a system for disabling an appliance in response to a signal from a smoke detector.

FIG. 4 illustrates a functional block diagram of a second embodiment of a system 400 for disabling an appliance in response to a signal from a smoke detector. The system 400 includes a pluralilty of smoke detectors (a.k.a. smoke alarms) 410 and a plurality of appliances 430. The appliances 430 may be, for example, gas stoves and ovens, electric stoves and ovens, microwave ovens, furnaces (gas or electric), or any combination thereof that are found and used in a kitchen or a basement, for example. Other types of appliances and locations of appliances are possible as well.

The system 400 includes a central computer or controller 420 and a plurality of safety devices 440, one safety device 440 for each appliance 430. The central computer 420 may be a microprocessor based computer such as, for example, a personal computer (PC). The safety devices 440 are operatively connected between the central computer 420 and the appliances 430 via a communication network. The central computer 420 is operatively connected between the smoke detectors 410 and the safety devices 440. Each of the safety devices 440 is also connected between an energy source (e.g., a combustible gas or an electric source) and an appliance 430 in, for example, a main line 435 leading from the energy source to the appliance 430.

During normal operation, the safety devices 440 allow energy (e.g., natural gas or electricity) to pass from the energy sources to the appliances 430. However, if at least one of the smoke detectors 410 detects smoke and activates an alarm, an interrupt signal 415 is generated within the smoke detector 410 and is sent from the smoke detector 410 to the central computer 420. In accordance with an embodiment of the present invention, the signal 415 serves as an interrupt to the central computer 420. When the central computer 420 receives the signal 415, the central computer 420 generates a message 425 and sends the message to each of the safety devices 440 over a network. The safety devices 440 effectively block the flow of energy from the energy sources to the appliances 430 in response to the message 425 from the central computer 420. Therefore, if any of the appliances 430 is the source of the detected smoke, then disabling the appliances 430 by blocking the flow of energy to the appliances 430 may help reduce or extinguish any associated fire causing the smoke.

In accordance with an embodiment of the present invention, the interrupt signal 415 may be sent from the smoke detectors 410 to the central computer 420 via wired means or wirelessly. The signal 415 may be a radio frequency (RF) signal, a pulsed signal, or a simple voltage level, for example. Other types of signals are possible as well. If the signal 415 is an RF signal, the smoke detectors 410 may include an RF transmitter to transmit the signal 415 and the central computer 420 may include an RF receiver to receive the signal 415. Such RF transmitters and receivers are well known in the art.

Similarly, in accordance with an embodiment of the present invention, the message 425 may be sent from the central computer 420 to the safety devices 440 via a wired network means or a wireless network means. The message 425 may be a radio frequency (RF) computer message or a wired computer message, for example. If the message 425 is an RF computer message, the central computer 420 may include an RF transmitter network communication interface to transmit the message 425, and each of the safety devices 440 may include an RF receiver network communication interface to receive the message 425. Such RF transmitter and receiver network communication interfaces are well known in the art.

If the message 425 is communicated via wired means (e.g., electrical or optical means), the central computer 420 and each of the safety devices 440 may include an appropriate network communication interface. Such network communication interfaces may include a serial interface (e.g., universal serial bus interface, RS-232), a parallel interface (e.g., an LPT1 interface), or an Ethernet interface. Such network communication interfaces are well known in the art. Other types of communication interfaces are possible as well.

As a result, the system of FIG. 4 is able to handle a plurality of smoke detectors 410 and a plurality of appliances 430 via a single central computer 420. Each of the smoke detectors 410 may be in a different room of a home or office, for example. Similarly, the appliances 430 may be distributed throughout one or more rooms in a home or office, for example.

In accordance with an embodiment of the present invention, a smoke detector 410 may be correlated to one or more appliances 430. For example, a smoke detector 410 in a kitchen may be correlated to an electric stove and oven in the kitchen as well as a microwave oven in the kitchen. If the smoke detector 410 in the kitchen detects smoke and is activated, a unique interrupt signal 415 (e.g., a unique interrupt to the central computer 420), corresponding only to the kitchen smoke detector 410 may be sent to the central computer 420 from the kitchen smoke detector 410. Then, the central computer 420 may recognize the signal 425 as being from the kitchen smoke detector 410 and send a message 425 over the network to shut down only the electric stove and oven in the kitchen as well as the microwave oven in the kitchen.

Similarly, for example, a smoke detector 410 in a basement may be correlated to a gas furnace in the basement. If the smoke detector 410 in the basement detects smoke and is activated, a unique interrupt signal 415 (e.g., a different unique interrupt), corresponding only to the basement smoke detector 410 may be sent to the central computer 420 from the basement smoke detector 410. Then, the central computer 420 may recognize the signal 425 as being from the basement smoke detector 410 and send a message 425 over the network to shut down only the gas furnace in the basement. Such flexibility may be designed into the system 400 by providing unique signals 415 and messages 425 for the various combinations of correlated smoke detectors 410 and appliances 430 and the associated safety devices 440. In accordance with an embodiment of the present invention, when an appliance(s) 430 is disabled, the associated safety device 440 may send a response message back to the central computer 420 to acknowledge that the appropriate appliance(s) 430 has been disabled.

Figure 5:
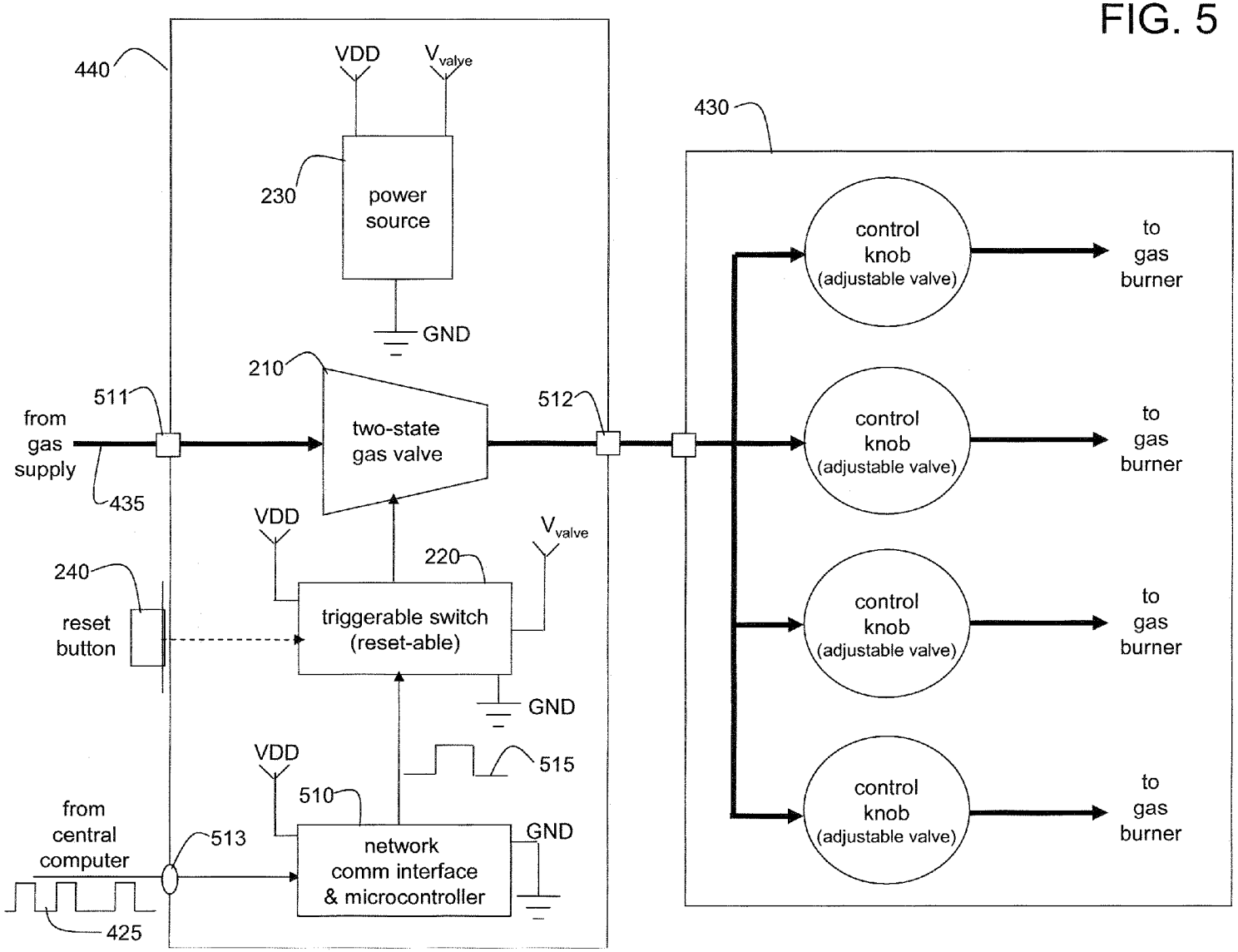
FIG. 5 illustrates a first embodiment of a safety device operatively connected to a first embodiment of an appliance for providing gas to at least one gas burner and used in the system of FIG. 4.

FIG. 5 illustrates a first embodiment of a safety device 440 operatively connected to a first embodiment of an appliance 430 for providing gas to at least one gas burner and used in the system 400 of FIG. 4. As shown in FIG. 5, a main gas line 435 from a gas supply (energy source) is connected to an input port 511 of the safety device 440. An output port 512 of the safety device 440 is connected to the gas appliance 430. In this manner, the safety device 440 is able to allow gas to pass from the gas supply to the gas appliance 430. The gas appliance 430 may be a stove and/or oven that operate using combustible natural gas or propane, for example.

The first embodiment of the safety device 440 includes a two-state gas valve 210 operatively connected to a triggerable switch 220. The two-state gas valve 210 is capable of being in a first flowing state (allowing gas to pass through the valve 210) or a second non-flowing state (preventing gas from passing through the valve 210). Gas coming into the input port 511 of the safety device 440 enters the gas valve 210. Gas leaves the gas valve 210 and exits through the output port 512 of the safety device 440.

FIG. 5 shows four control knobs within the appliance 430, each controlling an adjustable gas valve to provide gas to a separate stove burner. Gas out of the safety device 440 supplies gas for all four gas stove burners. The appliance 430 may also include an oven having at least one burner which is also supplied by gas passing through the safety device 440. During normal operation, the flow of gas follows a path from a gas supply through the two-state gas valve 210, through an adjustable gas valve of the appliance 430, and to a gas burner. A user may turn or rotate a control knob of the appliance 430 to initiate the turning on of a gas burner as described herein. The further a user rotates the control knob of the appliance 430, the more the adjustable gas valve of the appliance 430 opens. In this way, a user is able to adjust the amount of gas flowing between the gas supply and the gas burner and, therefore, the level of the resultant flame at the gas burner and the amount of heat being generated by the burner. When the gas reaches a gas burner, the gas may be ignited by, for example, an electric spark starter or a pilot light and, therefore, the gas burner is turned on.

When a smoke detector 410 is activated (i.e., detects smoke), the smoke detector 410 generates an interrupt signal 415 that is sent to the central computer 420. The central computer 420 then generates a message 425 which is sent to the safety device 440 over a communication network. The safety device 440 includes a network communication interface and microcontroller 510 which receives the message 425 from the central computer 420 through a communication port 513. Such network communication interfaces and microcontrollers are well known in the art. The network communication interface and microcontroller 510 may include, for example, a serial interface (e.g., universal serial bus interface, RS-232), a parallel interface (e.g., an LPT1 interface), or an Ethernet interface. Such network communication interfaces are well known in the art. Other types of communication interfaces are possible as well.

When the network communication interface and microcontroller 510 within the safety device 440 receives the message 425, the network communication interface and microcontroller 510 outputs a trigger pulse signal 515 to the triggerable switch 220 and causes the triggerable switch 220 to turn on or close, allowing a voltage $V_{valve}$ to be applied to an input of the two-state gas valve 210. The triggerable switch 220 is of the type that is triggered by a change (rising edge or falling edge) in a voltage logic level (e.g., the signal 515 transitioning from 0 VDC to 5 VDC). In accordance with an embodiment of the present invention, the triggerable switch includes at least one transistor. Such switches are well known in the art. The voltage $V_{valve}$ causes the two-state gas valve 210 to transition from an open (flowing) state to a closed (non-flowing) state, preventing gas from the gas supply from passing through the two-state gas valve 210 and on to the gas appliance 130.

The network communication interface and microcontroller 510 may include a one-shot device that is enabled by the message 425 when smoke is detected by the smoke detector 410 and generates the trigger pulse signal 515. Such one-shot devices are well known in the art. However, other types of devices may be used to generate the trigger pulse signal 515 as well. Furthermore, in accordance with other embodiments of the present invention, the triggerable switch 220 may be of a type that is triggered by a voltage logic level instead of a transitioning pulse (e.g., outputting 5 VDC, a logic high level). Such switches are well known in the art. In such an embodiment, the network communication interface and microcontroller 510 generates and outputs the voltage logic level using standard, well known digital circuitry.

In accordance with an embodiment of the present invention, the two-state gas valve 210 has an electromagnet inside which causes the gas valve 210 to close when a small charge or voltage $V_{valve}$ is applied at the electromagnet. Such gas valves are well known in the art. Other types of charge or voltage controlled gas valves may be possible as well. In accordance with an alternative embodiment of the present invention, the gas valve 210 may operate in an opposite manner. That is, the gas valve 210 may open when a small charge or voltage $V_{valve}$ is applied at the electromagnet. In such an embodiment, the voltage $V_{valve}$ would be applied to the gas valve 210 during normal operation, and when the signal 515 triggers the switch 220, the voltage $V_{valve}$ would be disconnected from the gas valve 210, causing the gas valve 210 to close.

Certain devices of the safety apparatus 120 may require electric power to be applied in order to function. For example, the triggerable switch 220 and the network communication interface and microcontroller 510 may require a voltage VDD and a ground potential GND to be applied, as shown in FIG. 5, in order to operate as described herein. The voltages VDD, $V_{valve}$, and the ground potential GND may be provided by a power source 230 which may be part of the safety device 440.

In accordance with an embodiment of the present invention, the power source 230 may include one or more batteries along with other circuitry for forming the direct current (DC) voltages VDD and $V_{valve}$ with respect to a ground potential GND. In accordance with another embodiment of the present invention, the power source 230 may include a power regulator/converter that takes in alternating current (AC) from, for example, a standard 220 VAC power source or a 110 VAC power source and converts the AC voltage to DC voltages VDD and $V_{valve}$. Such power sources are well known in the art. For example, VDD may be 5.0 VDC and $V_{valve}$ may be 1.0 VDC, in accordance with an embodiment of the present invention.

In accordance with an embodiment of the present invention, the various devices 220, 230, and 510 may be mounted on a printed circuit board (PCB) which provides the various electrical interfaces between the devices. The PCB with the mounted devices and the two-state gas valve 210 may be mounted substantially internally to the safety device 440 within a housing of the safety device 440. The safety device 440 also includes a reset button 240 operatively connected to the triggereable switch 220. The reset button 240 may be used to manually reset the two-state gas valve 210, via the triggerable switch 220, from the non-flowing state to the flowing state. The reset button 240 is mounted on the outside of the safety device 440 to allow user access. Such reset-able switches are well known in the art. In accordance with an alternative embodiment of the present invention, the central computer 420 may send a reset message to the safety device 440, causing the two-state gas valve 210 to be automatically reset to the flowing state via the network communication interface and microcontroller 510 and the triggerable switch 220.

Figure 6:
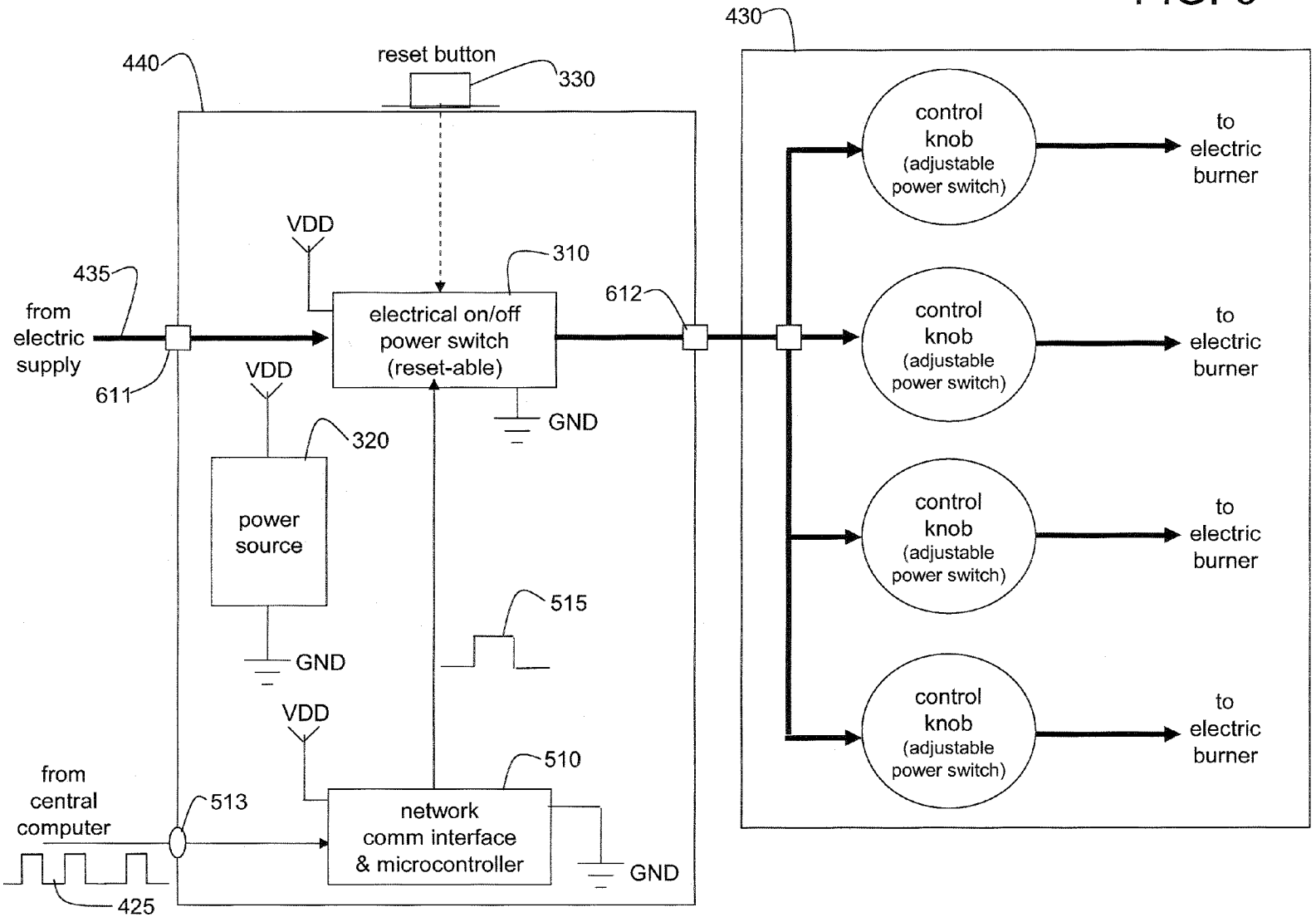
FIG. 6 illustrates a second embodiment of a safety device operatively connected to a second embodiment of an appliance for providing electricity to at least one electric burner and used in the system of FIG. 4.

FIG. 6 illustrates a second embodiment of a safety device 440 operatively connected to a second embodiment of an appliance 430 for providing electricity to at least one electric burner and used in the system 400 of FIG. 4. The appliance 430 may be a stove or oven having at least one electric burner that operates using electricity (i.e., electrical current), for example. As shown in FIG. 6, a main electrical line 435 from an electric supply (energy source) is connected to an electrical input connector port 611 of the safety device 440. An electrical output connector port 612 of the safety device 440 is connected to the electric appliance 430. In this manner, the safety device 440 is able to allow electricity to flow between the electric supply and the electric appliance 430.

The second embodiment of the safety device 440 includes an electrical on/off power switch 310. The electrical on/off power switch 310 is capable of being in a first conductive state (allowing electricity to flow through the switch 310) or a second non-conductive state (preventing electricity from flowing through the switch 310). Such electrical on/off power switches or well known in the art. Electricity coming into the input port 611 of the safety device 440 enters the switch 310. Electricity leaves the switch 310 and exits through the output port 612 of the safety device 440. The electrical on/off power switch may be rated to handle, for example, 220 VAC at 30 amps.

FIG. 6 shows four control knobs, each controlling an adjustable power switch to provide electricity to a separate stove burner. Electricity out of the safety device 440 supplies electricity for all four electric stove burners. The appliance 430 may also include an oven having at least one burner which is also supplied by electricity passing through the safety device 440. During normal operation, the flow of electric current follows a path between the electric supply and an electric burner through the electrical on/off power switch 310 of the safety device 440 and through an adjustable power switch of the appliance 430. A user may turn or rotate a control knob of the appliance 430 to initiate the turning on of the electric burner as described herein. The further a user rotates the knob of the appliance 430, the more the adjustable power switch of the appliance 430 provides electric current. In this way, a user is able to adjust the amount of electric current flowing between the electric supply and the electric burner and, therefore, the amount of heat being generated by the burner.

When the smoke detector 410 is activated (i.e., detects smoke), the smoke detector 410 generates an interrupt signal 415 that is sent to the central computer 420. The central computer 420 then generates a message 425 which is sent to the safety device 440. The safety device 440 includes a network communication interface and microcontroller 510 which receives the message 425 from the central computer 420 through a communication port 513. Such network communication interfaces and microcontrollers are well known in the art. The network communication interface and microcontroller 510 may include, for example, a serial interface (e.g., universal serial bus interface, RS-232), a parallel interface (e.g., an LPT1 interface), or an Ethernet interface. Such network communication interfaces are well known in the art. Other types of communication interfaces are possible as well.

When the network communication interface and microcontroller 510 within the safety device 440 receives the message 425, the network communication interface and microcontroller 510 outputs a trigger pulse signal 515 to the electrical on/off power switch 310 and causes the electrical on/off power switch 310 to turn off or open, preventing electrical current from flowing through the switch 310 from the electric supply to the electric appliance 430. The electrical on/off power switch 310 is of the type that is triggered by a change (rising edge or falling edge) in a voltage logic level (e.g., the signal 115 transitioning from 0 VDC to 5 VDC). In accordance with an embodiment of the present invention, the electrical on/off power switch 310 includes at least one power transistor. Such switches are well known in the art. When the electric current reaches a burner, the electric current heats up a coil of the burner and, therefore, the electric burner is turned on.

The network communication interface and microcontroller 510 may include a one-shot device that is enabled by the message 425 when smoke is detected by the smoke detector 410 and generates the trigger pulse signal 515. Such one-shot devices are well known in the art. However, other types of devices may be used to generate the trigger pulse signal 515 as well. Furthermore, in accordance with other embodiments of the present invention, the electrical on/off power switch 310 may be of a type that is triggered by a voltage logic level instead of a transitioning pulse (e.g., outputting 5 VDC, a logic high level). Such switches are well known in the art. In such an embodiment, the network communication interface and microcontroller 510 generates and outputs the voltage logic level using standard, well known digital circuitry.

The electrical on/off power switch 310 and the communication interface and microcontroller 510 may require electric power to be applied in order to function. For example, the switch 310 and the network communication interface and microcontroller 510 may require a voltage VDD and a ground potential GND to be applied, as shown in FIG. 6, in order to operate as described herein. The voltage VDD and the ground potential GND may be provided by a power source 320 which may be part of the safety device 440.

In accordance with an embodiment of the present invention, the power source 320 may include one or more batteries along with other circuitry for forming the direct current (DC) voltage VDD with respect to a ground potential GND. In accordance with another embodiment of the present invention, the power source 320 may include a power regulator/converter that takes in alternating current (AC) from, for example, a standard 220 VAC power source or a 110 VAC power source and converts the AC voltage to a DC voltages VDD. Such power sources are well known in the art. For example, VDD may be 5.0 VDC, in accordance with an embodiment of the present invention.

In accordance with an embodiment of the present invention, the various devices 310, 320, and 510 may be mounted on a printed circuit board (PCB) which provides the various electrical interfaces between the devices. The PCB with the mounted devices and the may be mounted substantially internally to the safety device 440 within a housing of the safety device 440. The safety device 440 also includes a reset button 330 operatively connected to the electrical on/off power switch 310. The reset button 330 may be used to manually reset the switch 310, from the non-conductive state to the conductive state. The reset button 330 is mounted on the outside of the safety device 440 to allow user access. Such reset-able power switches are well known in the art. In accordance with an alternative embodiment of the present invention, the central computer 420 may send a reset message to the safety device 440, causing the electrical on/off power switch 310 to be automatically reset to the conductive state via the network communication interface and microcontroller 510.

In accordance with an alternative embodiment of the present invention, the safety device may be integrated into the appliance, thus being an integral part of the appliance. In accordance with a further alternative embodiment of the present invention, the safety device may be integrated into an electrical outlet, thus being an integral part of the electrical outlet. The electrical outlet may be disabled via a smoke detector whether or not an electric appliance is plugged into the electrical outlet.

In summary, systems, methods, and apparatus for automatically disabling an appliance are disclosed. When a smoke detector/alarm is activated, a signal or message is sent to at least one safety device operatively coupled to at least one appliance. The appliance is disabled in response to receiving the signal or message. The systems, methods, and apparatus are based on the implicit assumption that, if a smoke detector/alarm is activated, the source of the smoke is likely due to a nearby appliance that is in use.

While the claimed subject matter of the present application has been described with reference to certain embodiments, it will be understood by those skilled in the art that various changes may be made and equivalents may be substituted without departing from the scope of the claimed subject matter. In addition, many modifications may be made to adapt a particular situation or material to the teachings of the claimed subject matter without departing from its scope. Therefore, it is intended that the claimed subject matter not be limited to the particular embodiment disclosed, but that the claimed subject matter will include all embodiments falling within the scope of the appended claims.

What is claimed is:

1. A method of automatically disabling appliances, said method comprising:

generating a unique interrupt signal within a smoke detector, wherein said unique interrupt signal identifies said smoke detector and is indicative of an alarm of said smoke detector being activated;

sending said unique interrupt signal to a central computer;

said central computer using said unique interrupt signal to correlate said smoke detector to a unique subset of a plurality of appliances;

said central computer sending a message to one or more safety devices associated with said unique subset of a plurality of appliances in response to said correlating, wherein each of said one or more associated safety devices operatively couples a source of energy to said unique subset of a plurality of appliances; and each of said one or more associated safety devices automatically de-coupling a source of energy from said unique subset of a plurality of appliances in response to said message.

2. The method of claim 1 wherein said automatically de-coupling includes opening a conductive electrical path within said one or more associated safety devices to prevent electricity from flowing to an electric burner of said unique subset of a plurality of appliances.

3. The method of claim 1 wherein said automatically de-coupling includes closing a gas valve of said one or more associated safety devices to prevent a combustible gas from flowing to a gas burner of said unique subset of a plurality of appliances.

4. The method of claim 1 wherein said automatically de-coupling includes opening a conductive electrical path within said one or more associated safety devices to prevent electricity from flowing to a microwave energy source of said unique subset of a plurality of appliances.

5. The method of claim 1 wherein said unique subset of a plurality of appliances includes at least one of a gas stove, an electric stove, a gas oven, an electric oven, a microwave oven, a gas furnace, an electric furnace, a heat pump, an electric skillet, a hot plate, and a combination thereof.

6. The method of claim 1 further comprising manually re-coupling a source of energy to said unique subset of a plurality of appliances via a reset button on each of said one or more associated safety devices.

7. The method of claim 1 further comprising automatically re-coupling a source of energy to said unique subset of a plurality of appliances via a reset message from said central computer to said one or more associated safety devices.

8. The method of claim 1 further comprising:

generating a second unique interrupt signal within a second smoke detector, wherein said second unique interrupt signal identifies said second smoke detector and is indicative of an alarm of said second smoke detector being activated;

sending said second unique interrupt signal to said central computer;

said central computer using said second unique interrupt signal to correlate said second smoke detector to a second unique subset of said plurality of appliances;

said central computer sending a second message to one or more different safety devices associated with said second unique subset of said plurality of appliances in response to said correlating, wherein each of said one or more different associated safety devices operatively couples a source of energy to said second unique subset of said plurality of appliances; and each of said one or more different associated safety devices automatically de-coupling said source of energy from said second unique subset of said plurality of appliances in response to said second message.

9. The method of claim 8 further comprising each of said one or more different associated safety devices sending a response message back to said central computer acknowledging that said second unique subset of said plurality of appliances is disabled.

10. The method of claim 1 further comprising each of said one or more associated safety devices sending a response message back to said central computer acknowledging that said unique subset of a plurality of appliances is disabled.

11. A system providing an automatic safety capability, said system comprising:

a plurality of appliances;

means for operatively coupling and decoupling a source of energy to each of said plurality of appliances;

means for detecting smoke and generating a unique interrupt signal in response to detecting smoke, wherein said unique interrupt signal identifies said means for detecting smoke;

means for receiving said unique interrupt signal, using said unique interrupt signal to correlate said means for detecting smoke to a subset of said plurality of appliances, and generating a message in response to receiving said unique interrupt signal, and;

means for communicating said message to a subset of said means for operatively coupling and decoupling associated with said subset of appliances, wherein said subset of said means for operatively coupling and decoupling is configured to decouple a source of energy from each of said subset of appliances in response to said message.

12. The system of claim 11 further comprising means for manually re-coupling a source of energy to each appliance of said subset of appliances.

13. The system of claim 11 further comprising means for automatically re-coupling a source of energy to each appliance of said subset of appliances.

14. The system of claim 11 wherein said subset of appliances includes at least one of a gas stove, an electric stove, a gas oven, an electric oven, a microwave oven, a gas furnace, an electric furnace, a heat pump, an electric skillet, a hot plate, and a combination thereof.

15. An automated safety device, said safety device comprising:

a two-state gas valve having a gas input port and a gas output port and capable of providing a flow state and a non-flow state;

a switch operatively connected to said two-state gas valve to change said gas valve from said flow state to said non-flow state in response to a signal; and a communication interface and microcontroller operatively connected to said switch to receive a message from an external central computer and to provide said signal to said switch in response to said message, wherein said automated safety device is self-contained and is configured to operatively connect between an energy source and an appliance.

16. The safety device of claim 15 further comprising a power source operatively connected to said switch for providing electrical power used by said switch.

17. The safety device of claim 15 further comprising a reset device operatively connected to said switch to manually reset said switch such that said gas valve changes from said non-flow state to said flow state.

18. The system of claim 11 further comprising means for acknowledging when a source of energy is decoupled from each appliance of said subset of appliances.

19. The safety device of claim 15 further comprising a power source operatively connected to said communication interface and microcontroller for providing electrical power used by said communication interface and microcontroller.

20. An automated safety device, said safety device comprising:

an electrical on/off power switch having an electrical power input port and an electrical power output port and capable of switching from a conductive state to a non-conductive state in response to a signal; and a communication interface and microcontroller operatively connected to said electrical on/off power switch to receive a message from an external central computer and to provide said signal to said electrical on/off power switch in response to said message, wherein said automated safety device is self-contained and is configured to operatively connect between an energy source and an appliance.

21. The safety device of claim 20 further comprising a power source operatively connected to said electrical on/off power switch for providing electrical power used by said electrical on/off power switch.

22. The safety device of claim 20 further comprising a reset device operatively connected to said electrical on/off power switch to manually reset said electrical on/off power switch back to said conductive state.

23. The safety device of claim 20 further comprising a power source operatively connected to said communication interface and microcontroller for providing electrical power used by said communication interface and microcontroller.

* * * * *